US012460414B2

(12) United States Patent
Dente

(10) Patent No.: US 12,460,414 B2
(45) Date of Patent: Nov. 4, 2025

(54) INSULATION FOR STRUCTURAL INSULATED PANELS

(71) Applicant: Verdant Building Products, Berkeley, CA (US)

(72) Inventor: Anthony Dente, Berkeley, CA (US)

(73) Assignee: VERDANT BUILDING PRODUCTS, Berkeley, CA (US)

( * ) Notice: Subject to any disclaimer, the term of this patent is extended or adjusted under 35 U.S.C. 154(b) by 229 days.

(21) Appl. No.: 18/447,487

(22) Filed: Aug. 10, 2023

(65) Prior Publication Data

US 2025/0052059 A1 Feb. 13, 2025

(51) Int. Cl.

| | |
|---|---|
| ***E04C 2/284*** | (2006.01) |
| ***E04B 1/80*** | (2006.01) |
| ***E04C 2/16*** | (2006.01) |
| ***E04C 2/30*** | (2006.01) |
| *E04B 1/74* | (2006.01) |

(52) U.S. Cl.

CPC ..... *E04C 2/284* (2013.01); *E04B 1/80* (2013.01); *E04C 2/16* (2013.01); *E04C 2/30* (2013.01); *E04B 2001/745* (2013.01)

(58) Field of Classification Search

CPC ... E04C 2/284; E04C 2/30; E04C 2/16; E04C 2/386; E04B 2001/745; E04B 1/80

USPC ..... 52/404.3, 309.11, 794.1

See application file for complete search history.

(56) References Cited

U.S. PATENT DOCUMENTS

| | | | | |
|---|---|---|---|---|
| 4,471,591 | A * | 9/1984 | Jamison | E04B 1/10 52/404.3 |
| 5,365,716 | A * | 11/1994 | Munson | E04B 1/7604 52/404.1 |
| 5,953,883 | A * | 9/1999 | Ojala | E04B 1/26 52/270 |
| 6,279,284 | B1 * | 8/2001 | Moras | E04F 13/007 52/483.1 |
| 6,308,491 | B1 * | 10/2001 | Porter | E04F 13/0875 52/794.1 |
| 11,718,989 | B2 * | 8/2023 | Baily | B32B 3/14 52/309.7 |
| 2013/0104480 | A1 * | 5/2013 | Smith | B29C 39/10 52/309.7 |
| 2013/0192157 | A1 * | 8/2013 | Coyle | B32B 21/047 52/586.1 |
| 2024/0269883 | A1 * | 8/2024 | Destrémau | B27N 3/002 |

FOREIGN PATENT DOCUMENTS

| | | | | |
|---|---|---|---|---|
| FR | 2990221 | A1 * | 11/2013 | E04B 1/88 |

* cited by examiner

*Primary Examiner* — Brent W Herring

(74) *Attorney, Agent, or Firm* — Donald R. Boys; Central Coast Patent Agengy LLC

(57) ABSTRACT

A building panel has a frame of horizontal and vertical elements, having an overall width, a length and a thickness, one or more volumes within the frame, and insulative material in the one or more volumes, the insulative material comprising plant matter chopped into pieces having a specific range of size, mixed with binder matter holding proximate pieces of the plant matter together. The binder matter is no more than ten percent of the weight of the insulative material, and the insulative material impedes heat transfer across the thickness of the building panel.

14 Claims, 4 Drawing Sheets

INSULATION FOR STRUCTURAL INSULATED PANELS

BACKGROUND OF THE INVENTION

1. Field of the Invention

The present invention is in the technical field of modular prefabricated structural components and relates more particularly to structural insulated panels (SIPS).

2. Description of Related Art

Modular and prefabricated components for use in developing structures for residences and commercial buildings are notoriously well known in the art. In a particular circumstance, insulated panels, such as prefabricated panels insulated with polymer foam of various sorts, are well known and are referred to as F-SIPS. It is also well known that creation and production of the polymer insulating materials for F-SIPS is not carbon neutral. It is desirable in the present circumstance of global warming to reduce carbon emissions to a minimum, and a significant quantity of carbon is released into the atmosphere in the thermal and chemical procedures producing polymer foam.

What is clearly needed in the art is apparatus and process for providing insulation that does not release carbon into the atmosphere and even sequesters it. Plants capture carbon through photosynthesis and straw is a proven plant-based insulation material as it is produced in harvesting crops that bind carbon. Straw-insulated structural panels, termed hereafter S-SIPS and the procedures of growing additional straw crops and processing same into insulation for prefabricated structural panels can make a significant difference in carbon emissions.

BRIEF SUMMARY OF THE INVENTION

In one embodiment of the invention a building panel is provided, comprising a frame of horizontal and vertical elements, having an overall width, a length and a thickness, one or more volumes within the frame, and insulative material in the one or more volumes, the insulative material comprising plant matter chopped into pieces having a specific range of size, mixed with binder matter holding proximate pieces of the plant matter together. The binder matter is no more than ten percent of the weight of the insulative material, and wherein the insulative material impedes heat transfer across the thickness of the building panel.

In one embodiment the insulative material is straw from one of or a mixture of wheat, rice barley or oats, chopped into individual strands varying in length between 1/32 and twelve inches. Also, in one embodiment the binder matter comprises nanocellulose or sugar or starch-based material in a first uncured state as a solution and cured by crystallization to a second cured state. In one embodiment the binder matter comprises one or more naturally occurring wax materials added in the first uncured state semi-liquid at an elevated temperature and cured by cooling to a semi-rigid cured state. And in one embodiment the binder matter comprises a material liquid or semi-liquid in the first state and curable to a second cured semi-rigid state chemically by addition of a reactive agent.

In one embodiment the horizontal and vertical elements of the frame comprise a cap beam and a base beam each having a first width and a same length defining a width of the building panel, a first vertical stud having a first length spanning from the cap beam to the base beam, forming a first vertical edge of the panel and defining a height of the building panel, a second vertical stud of the first length spanning from the cap beam to the base beam, forming a second vertical edge of the panel opposite the first vertical edge, a third vertical stud of the first length spanning from the cap beam to the base beam at a location midway between the first and the second vertical studs, and a structural sheathing of the width and height of the panel joined to a rear of the panel, the structure forming a first volume between the cap beam, base beam and the first and third vertical studs, and a second volume between the cap beam, the base beam, and the second and third vertical studs, the two volumes filled with the insulative material.

In one embodiment the first vertical stud and the second vertical stud are of a lesser width than the base and cap beams and bear against the structural sheathing at the rear of the building panel, leaving a space to the front of the building panel, and the third vertical stud is placed even with the forward edges of the base and cap beams, leaving a space between the third vertical stud and the structural sheathing, the spaces limiting conductive heat transfer through the thickness of the building panel. Also, in one embodiment the building panel further comprises wooden strips fastened vertically on the rear of the panel, over the structural sheathing, providing a rainscreen space. In one embodiment the building panel further comprises wooden strips fastened from side to side on the front of the panel, providing a space for electrical wiring. And in one embodiment the building panel further comprises a layer of fabric netting of the width and height of the building panel fastened to the cap and base beams, the layer of netting facilitating retaining the straw material in the volumes of the building panel.

In a different aspect of the invention a method for forming a building panel is provided, comprising implementing a frame of horizontal and vertical elements, the frame having an overall width, a length and a thickness, the frame defining one or more volumes within the frame, placing insulative material in the one or more volumes, the insulative material comprising plant matter chopped into pieces having a specific range of size, mixed with binder matter holding proximate pieces of the plant matter together. The binder matter is no more than ten percent of the weight of the insulative material and the insulative material impedes heat transfer across the thickness of the building panel.

In one embodiment the method further comprises forming the insulative material from straw from one of or a mixture of wheat, rice barley or oats, chopped into individual strands varying in length between 1/32 and twelve inches. In one embodiment the method further comprises selecting binding matter as nanocellulose or sugar or starch-based material in a first uncured state as a solution and cured by crystallization to a second cured state. In one embodiment the method further comprises selecting binder matter as one or more naturally occurring wax materials added in the first uncured state semi-liquid at an elevated temperature and cured by cooling to a semi-rigid cured state. And in one embodiment the method further comprises selecting binder matter as material liquid or semi-liquid in the first state and curable to a second cured semi-rigid state chemically by addition of a reactive agent.

In one embodiment the method further comprises forming the frame with the horizontal and vertical elements comprising a cap beam and a base beam each having a first width and a same length defining a width of the building panel, a first vertical stud having a first length spanning from the cap beam to the base beam, forming a first vertical edge of the panel and defining a height of the building panel, a second vertical stud of the first length spanning from the cap beam to the base beam, forming a second vertical edge of the panel opposite the first vertical edge, a third vertical stud of the first length spanning from the cap beam to the base beam at a location midway between the first and the second vertical studs, and a structural sheathing of the width and height of the panel joined to a rear of the panel, the structure forming a first volume between the cap beam, base beam and the first and third vertical studs, and a second volume between the cap beam, the base beam, and the second and third vertical studs, the two volumes filled with the insulative material.

In one embodiment the method further comprises forming the frame with the first vertical stud and the second vertical stud of a lesser width than the base and cap beams and bear against the structural sheathing at the rear of the building panel, leaving a space to the front of the building panel, and placing the third vertical stud even with the forward edges of the base and cap beams, leaving a space between the third vertical stud and the structural sheathing, the spaces limiting conductive heat transfer through the thickness of the building panel. In one embodiment the method further comprises fastening wooden strips vertically on the rear of the panel, over the structural sheathing, providing a rainscreen space. In one embodiment the method further comprises fastening wooden strips from side to side on the front of the panel, providing a space for electrical wiring. And in one embodiment the method further comprises imposing a layer of fabric netting of the width and height of the building panel fastened to the cap and base beams, the layer of netting facilitating retaining the straw material in the volumes of the building panel.

DETAILED DESCRIPTION OF THE INVENTION

An important object of the present invention is to provide building panels that minimize heat transfer across the panels and do so by incorporating insulative material in the panels that derive from plant material, which binds carbon. In embodiments of the present invention building panels are provided that limit heat transfer through the panels by features of construction of the panels, and also by incorporating insulative material that is straw from various sources, treated with a binder to old the straw together, as is needed to have panels that may be stored, shipped and manipulated in building procedures.

Figure 1:
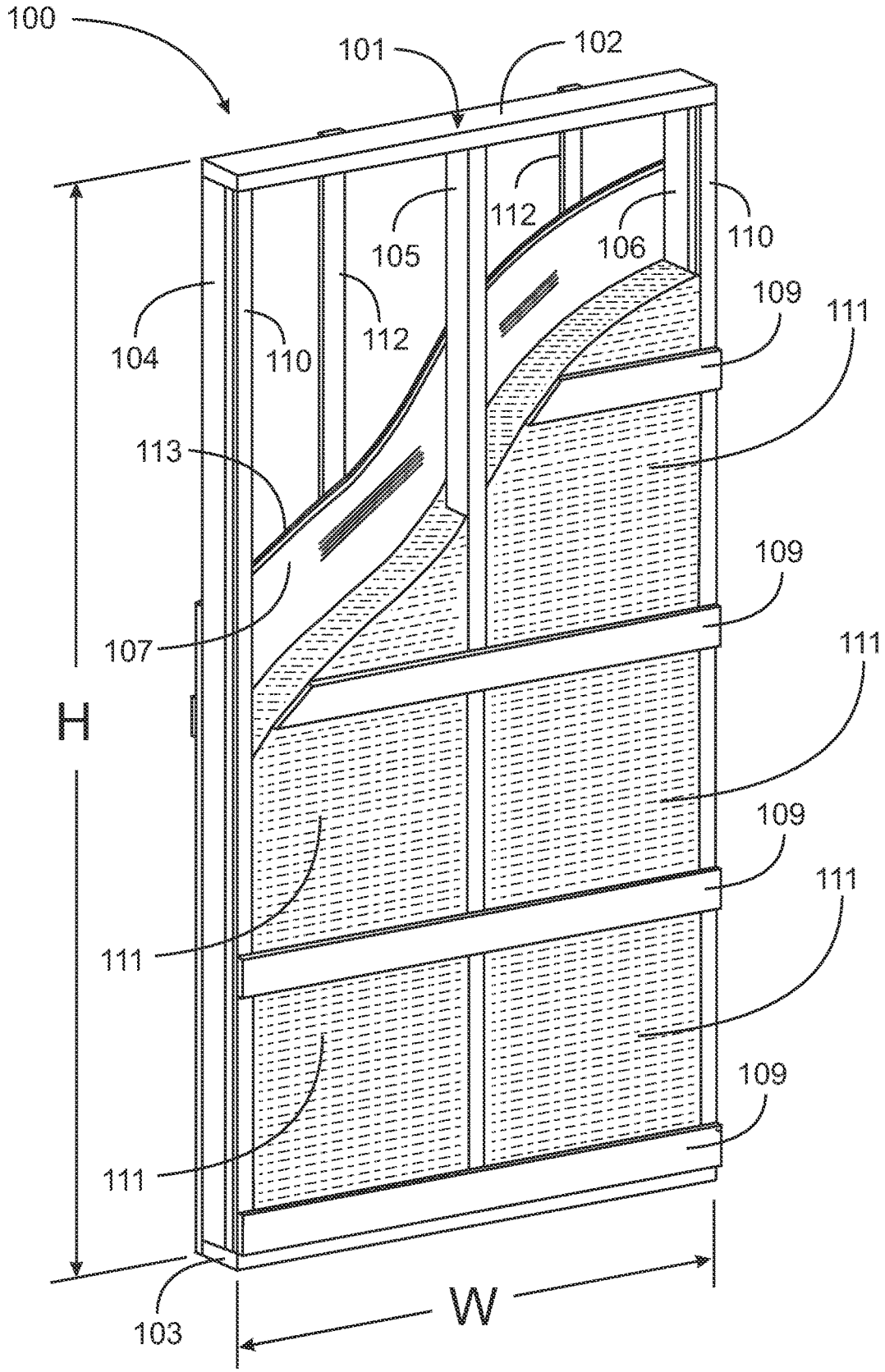
FIG. 1 is a perspective view of a straw insulated structural panel in an embodiment of the present invention.

FIG. 1 is a perspective view of a straw insulated structural panel 100 in an embodiment of the present invention, from a viewpoint within a building, such that the front surface of the structure in FIG. 1 faces into the building and the back surface is to the outside. Panel 100 in this embodiment has a rectangular frame 101 that has a cap beam 102 and a base beam 103. In one embodiment the cap beam and the base beam are both 2×6 lumber, having a width of 5.5 inches. In alternative embodiments the cap beam and the base beam may be wider, such as 2×8, and in some embodiments may be other than lumber, such as a combination of wood pulp and synthetic materials covered with a synthetic shell, similar to decking materials. In one embodiment W is four feet and His eight feet, and in another the dimensions are four by ten feet. The overall dimensions are determined in some cases by standard sizes for structural panels, but these dimensions are not limiting to the scope of the invention.

Frame 101 has, in this example, three vertical studs 104, 105 and 106 that, in this example, are 2×4 lumber, 3.5 inches in width. In other embodiments the studs may be other than lumber, such as a combination of wood pulp and synthetic materials covered with a synthetic shell, similar to decking materials. Studs 104 and 106 form partial outer edges of frame 101 and the rear edge of studs 104 and 106 are even with the rear edge of cap and base beams 102 and 103. Vertical stud 105, however, has an inner edge that is even with the forward edge of cap and base beams 102 and 103. The lesser depth of the three studs, and the staggering of the studs, minimizes thermal bridging through the structure. A vertical strip 110 is added along the forward edge of vertical studs 104 and 106 to even out the overall size of the building panel, and this strip does not contact the vertical studs.

Structural panel 100 has a structural sheathing panel 107 covering the rear of frame 101. The structural sheathing panel may be one-quarter, one half, or three quarters thickness plywood in alternative embodiments. In alternative embodiments the sheathing panel may be other than plywood, such as, for example, weatherboard or fiberboard. The sheathing panel has in some embodiments an additional weather barrier 113, preferably of a biodegradable material. Vertical strips of wood 112, in some embodiments 1×2 inch, is added on the back side to provide a rainscreen as a space between the sheathing and siding, allowing moisture to evaporate.

In this example a series of cross pieces 109, spanning the width of the building panel on the forward side, and spaced apart vertically, act as chase strips to provide space for electrical wiring. These strips may be 1×2 inch lumber, or in some cases 1×4.

The internal volumes of the building panel, for the full depth of the frame, are filled with an especially prepared straw material 111. Straw material 111 in one embodiment is prepared from dried straw that has been chopped in a chopping machine to individual strands that may vary between one-half inch to about 1 inch in length. The individual strands may vary within a predetermined range in length. The type of straw may vary. The original straw may be wheat, rice, barley or oat straw depending on a number of factors, such as, for example, availability and cost. In some embodiments a mixture of different types of straw may be used.

Although the panels described above have staggered studs, that is, the cap and base beams may be greater in depth than the studs, to minimize conductive heat transfer through the panel, in some embodiments the cap and base beams and the studs may be of equal depth.

Figure 2A:
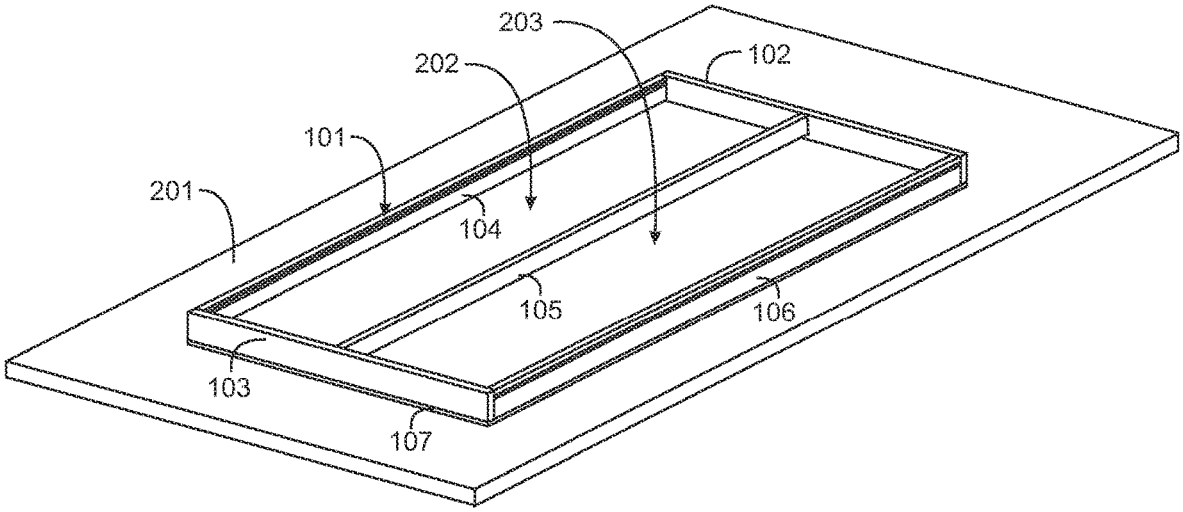
FIG. 2A is a perspective view of a sturdy support plate supporting a frame for a building panel in an embodiment of the invention.

FIG. 2A is a perspective view of a sturdy support plate 201 supporting a frame 101 for a building panel in an embodiment of the invention. In FIG. 2A frame 101 has structural sheathing 107 attached, but not the rainscreen strips on the back or the chase strips on the front. In this circumstance frame 101 presents two side-by-side volumes 202 and 203 upward.

Figure 2C:
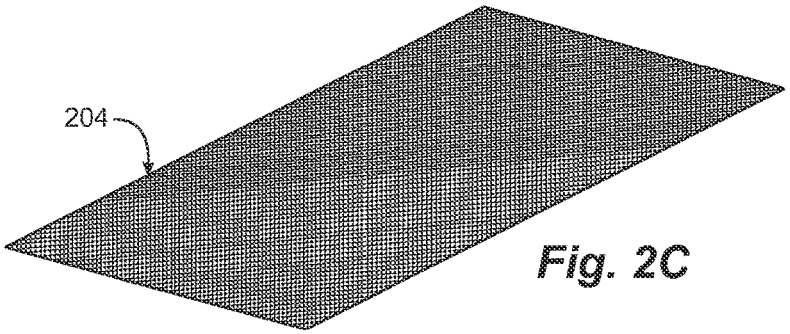
FIG. 2C illustrates a rectangular section of fabric hardware netting of the width and length of the frame of FIG. 2B.
Figure 2B:
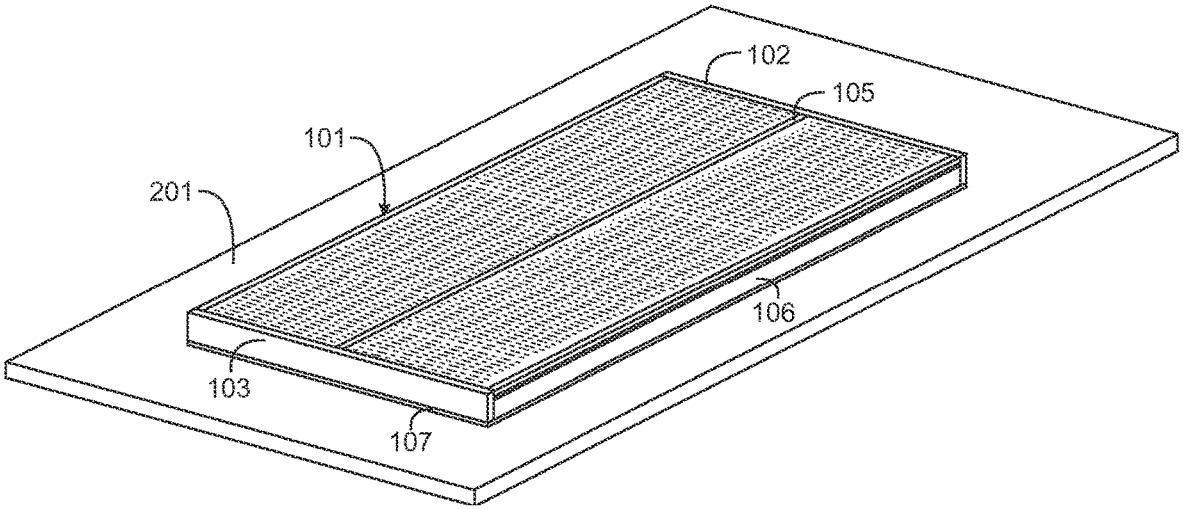
FIG. 2B illustrates the frame of FIG. 2A filled with chopped straw

In one embodiment of a method to apply the insulation material into the open frame, dried straw is fed through the chopping machine and blown or poured after chopping into the side-by-side volumes of the panel frame. FIG. 2B illustrates frame 101 filled with chopped straw. FIG. 2C illustrates a rectangular section of a natural fiber fabric netting of the width and length of frame 101. In one embodiment after the frame volumes are filled with chopped straw, netting 204 is placed over the frame and stapled or nailed to the edges of the cap beam, base beam, and studs to retain the chopped straw in the frame. Once netting 204 is attached, the chase strips and rainscreen strips may also be attached, and the building panel is finished.

In an alternative method the chopped straw may be treated with an additive binder and formed into the volumes of the frame while the binder has yet to cure. In some embodiments the binder may be nanocellulose or sugar or starch-based material. Natural waxes may also be used as binders. After filling the frame the binder material may harden by a chemical or a physical process and cause the chopped straw to form a semi-solid form. In some cases the binder may be liquid at a temperature at application and may gel on cooling. There are a wide variety of materials that might be used as a binder. Some are polymeric. Other chemical fillers may be used as well. Naturally derived admixtures are preferably used. In some circumstances chopped straw with a binder may be used and a fabric netting or screen may be employed as well.

Straw might in some embodiments be long strand. In other embodiments the straw may be chopped to specific parameters that denote both a gradient and proportion of straw fiber sizes, for example from roughly 12" in length down to roughly 1/32 inches in length. The chapped straw may be cleaned to remove small straw particles by graded screening and by moving air over the straw to remove fines and dust. In some cases a binder may be heated before being added to straw particles, and in some processes the straw particles may be heated without a binder. In some processes industrial agricultural machinery may be used in the processing of straw.

An important feature of the processing a straw with or without a binder is to create a straw matrix with a microstructure that significantly improves upon the thermal performance of unprocessed straw.

Figures 3A, 3B:
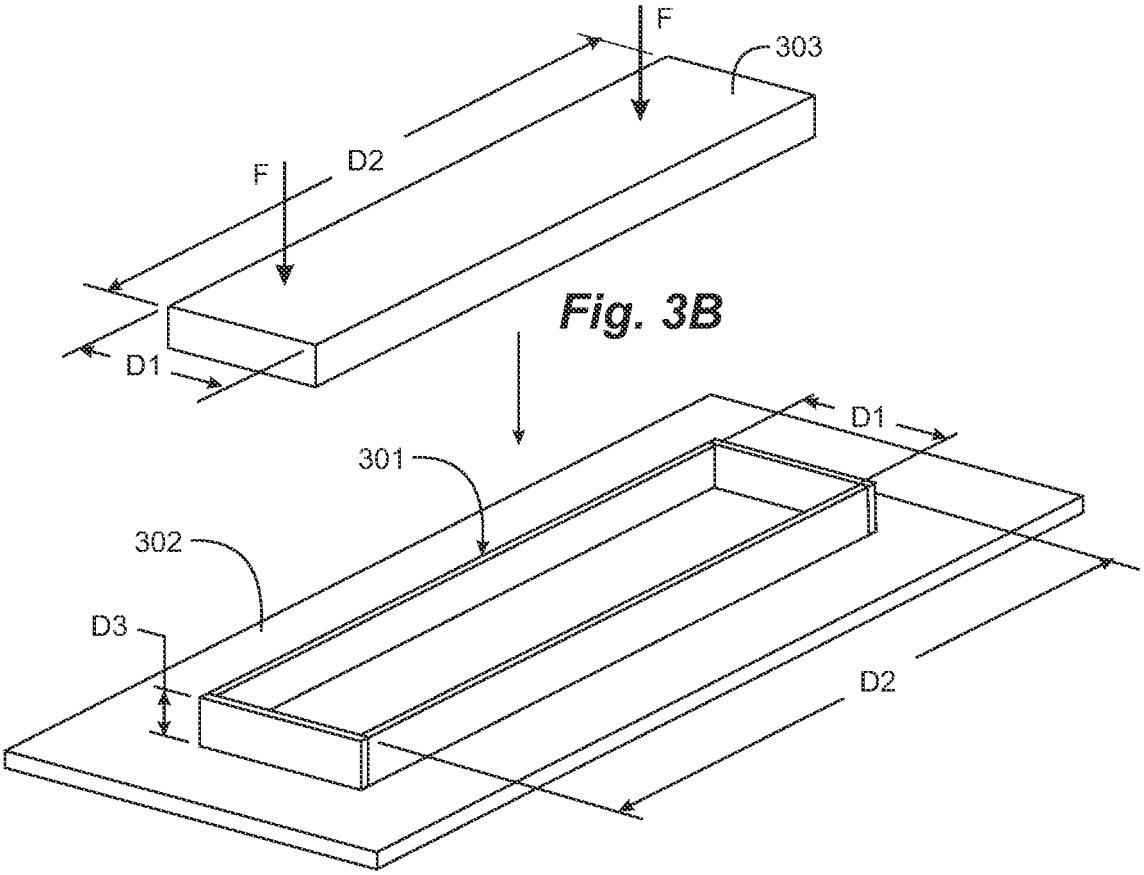
FIG. 3A is a perspective view of a mold in an embodiment of the invention.
FIG. 3B is a perspective view of a ram to fit in the mold of FIG. 3A

In yet another alternative method as illustrated in FIG. 3A a mold 301 is constructed with an internal volume of a width D1 and length D2 equal to the internal dimensions of frame 101 between the cap and base beams and studs 104 and 105. A depth D3 of the mold is greater than the depth of the frame 101, perhaps in some cases as much as twice or more. FIG. 3B illustrates a ram 303 of width D1 and length D2 trimmed to fit into mold 301. In practice straw is chopped and mixed with a binder material and mold 301 is filled to the top (depth D3) with the treated chopped straw. Ram 303 is placed over the chopped straw in the mold and urged downward by forces F. The treated chopped straw in mold 301 is compressed until the thickness of the mass of straw in the mold is the depth of frame 101, that is, the width of 2×6 lumber. The chopped straw in the mold is held at the compressed thickness until the binder cures, and the ram may be removed. The mold may then be disassembled or upturned to remove the compressed straw, which, by virtue of the cured binder, may form a semi-rigid, self-supporting block. In some cases reinforcement such as one or more wooden rods laid lengthwise in the mold may be included to help the released straw block to maintain the shape.

In practice straw blocks may be manufactured as described above and stored until needed in the manufacture of building panels according to embodiments of the invention. Such straw blocks may be moved and stored between plywood panels. Building panels are constructed up to the point of adding the rainscreen strips and the chase strips, and straw blocks manufactured as described above may be placed into the side-by-side volumes in the frames of the panels, then the rainscreen strips and chase strips may be added to complete the panels. In this example the chase strips may be enough restraint to hold the straw blocks in place.

There may be in embodiments of the invention a variety of methods and processes employed. In assembly of structural panels in embodiments of the invention traditional, that is conventional, framing methods of nailing and screwing in a factory setting may be practiced. Assembly line methods may also be used with automated machines. Processes to be performed either manually or by machines may include:

Moving material from stacks to be processed
Cutting material to size
O Nailing/screwing framing together
Nailing/screwing sheathing onto framing
Handling panels (flipping over, standing upright, etc.)
Moving panel down the assembly line to different stations
Adding straw to cavity
Sandwiching the panel between temporary rigid plates to resist bulging forces during insulation densification, vertically filling with straw, removing plates Processes in straw installation may include:

Compressing horizontal layers with a hydraulic or pneumatic press
Compressing vertical layers with a hydraulic or pneumatic press
Blowing insulation matrix into panel volumes
Filling the panel and using vibratory consolidation either via an internal vibrating tamper (similar to concrete) or external vibration of the panel Straw installation density is likely to be in the range of 6 pcf-14 pcf The skilled person will be aware that the embodiments described above, both of methods and apparatus, are entirely exemplary, and are not limiting to the scope of the invention. There are a wide range of variations that might be made within the scope of the invention, which is limited only by the claims.

The invention claimed is:

1. A building panel, comprising:

a frame of horizontal and vertical elements, having an overall width, a length and a thickness;

one or more volumes within the frame; and insulative material in the one or more volumes, the insulative material comprising plant matter chopped into pieces having a specific range of size, mixed with a liquid binder matter, curable by addition of a chemically reactive agent, the cured binder matter holding proximate pieces of the plant matter together;

wherein the dry binder matter is no more than ten percent of the dry weight of the insulative material, and wherein the insulative material impedes heat transfer across the thickness of the building panel.

2. The building panel of claim 1 wherein the insulative material is straw from one of or a mixture of wheat, rice barley or oats, chopped into individual strands varying in length between 1/32 and twelve inches.

3. The building panel of claim 1 wherein the horizontal and vertical elements of the frame comprise a cap beam and a base beam each having a first width and a same length defining a width of the building panel, a first vertical stud having a first length spanning from the cap beam to the base beam, forming a first vertical edge of the panel and defining a height of the building panel, a second vertical stud of the first length spanning from the cap beam to the base beam, forming a second vertical edge of the panel opposite the first vertical edge, a third vertical stud of the first length spanning from the cap beam to the base beam at a location midway between the first and the second vertical studs, and a structural sheathing of the width and height of the panel joined to a rear of the panel, the structure forming a first volume between the cap beam, base beam and the first and third vertical studs, and a second volume between the cap beam, the base beam, and the second and third vertical studs, the two volumes filled with the insulative material.

4. The building panel of claim 3 wherein the first vertical stud and the second vertical stud are of a lesser width than the base and cap beams and bear against the structural sheathing at the rear of the building panel, leaving a space to the front of the building panel, and the third vertical stud is placed even with the forward edges of the base and cap beams, leaving a space between the third vertical stud and the structural sheathing, the spaces limiting conductive heat transfer through the thickness of the building panel.

5. The building panel of claim 3 further comprising wooden strips fastened vertically on the rear of the panel, over the structural sheathing, providing a rainscreen space.

6. The building panel of claim 5 further comprising wooden strips fastened from side to side on the front of the panel, providing a space for electrical wiring.

7. The building panel of claim 3 further comprising a layer of fabric netting of the width and height of the building panel fastened to the cap and base beams, the layer of netting facilitating retaining the straw material in the volumes of the building panel.

8. A method for forming a building panel, comprising:

implementing a frame of horizontal and vertical elements, the frame having an overall width, a length and a thickness, the frame defining one or more volumes within the frame;

placing insulative material in the one or more volumes, the insulative material comprising plant matter chopped into pieces having a specific range of size, mixed with a liquid binder matter, curable by addition of a chemically reactive agent; and adding the chemically reactive agent;

wherein the cured binder matter holds proximate pieces of the plant matter together, the binder matter is no more than ten percent of the weight of the insulative material and the insulative material impedes heat transfer across the thickness of the building panel.

9. The method of claim 8 further comprising forming the insulative material from straw from one of or a mixture of wheat, rice barley or oats, chopped into individual strands varying in length between 1/32 and twelve inches.

10. The method of claim 8 further comprising forming the frame with the horizontal and vertical elements comprising a cap beam and a base beam each having a first width and a same length defining a width of the building panel, a first vertical stud having a first length spanning from the cap beam to the base beam, forming a first vertical edge of the panel and defining a height of the building panel, a second vertical stud of the first length spanning from the cap beam to the base beam, forming a second vertical edge of the panel opposite the first vertical edge, a third vertical stud of the first length spanning from the cap beam to the base beam at a location midway between the first and the second vertical studs, and a structural sheathing of the width and height of the panel joined to a rear of the panel, the structure forming a first volume between the cap beam, base beam and the first and third vertical studs, and a second volume between the cap beam, the base beam, and the second and third vertical studs, the two volumes filled with the insulative material.

11. The method of claim 10 further comprising forming the frame with the first vertical stud and the second vertical stud of a lesser width than the base and cap beams and bear against the structural sheathing at the rear of the building panel, leaving a space to the front of the building panel, and placing the third vertical stud even with the forward edges of the base and cap beams, leaving a space between the third vertical stud and the structural sheathing, the spaces limiting conductive heat transfer through the thickness of the building panel.

12. The method of claim 10 further comprising fastening wooden strips vertically on the rear of the panel, over the structural sheathing, providing a rainscreen space.

13. The method of claim 12 further comprising fastening wooden strips from side to side on the front of the panel, providing a space for electrical wiring.

14. The method of claim 10 further comprising imposing a layer of fabric netting of the width and height of the building panel fastened to the cap and base beams, the layer of netting facilitating retaining the straw material in the volumes of the building panel.

* * * * *